US009869048B2

(12) United States Patent
Burgess et al.

(10) Patent No.: US 9,869,048 B2
(45) Date of Patent: Jan. 16, 2018

(54) LAUNDRY TREATING APPLIANCE WITH LAUNDRY DEFLECTOR

(71) Applicant: Whirlpool Corporation, Benton Harbor, MI (US)

(72) Inventors: Brent M. Burgess, Edwardsburg, MI (US); Amanda E. King, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 423 days.

(21) Appl. No.: 14/548,343

(22) Filed: Nov. 20, 2014

(65) Prior Publication Data

US 2016/0145790 A1 May 26, 2016

(51) Int. Cl.
*D06F 37/26* (2006.01)
*D06F 39/14* (2006.01)

(52) U.S. Cl.
CPC ..... *D06F 37/267* (2013.01); *D06F 37/266* (2013.01); *D06F 39/14* (2013.01)

(58) Field of Classification Search
None
See application file for complete search history.

(56) References Cited

U.S. PATENT DOCUMENTS

| | | | |
|---|---|---|---|
| 8,109,011 | B2 | 2/2012 | Prajescu |
| 8,261,582 | B2 | 9/2012 | Graute et al. |
| 2007/0163144 | A1 | 7/2007 | Dittmer et al. |
| 2013/0276322 | A1 | 10/2013 | Anderson et al. |

FOREIGN PATENT DOCUMENTS

| | | | | |
|---|---|---|---|---|
| DE | 4311740 | A1 | 10/1994 | |
| EP | 1321558 | A1 | 6/2003 | |
| EP | 1321559 | A1 | 6/2003 | |
| EP | 1522623 | B1 | 5/2010 | |
| JP | 2007202741 | A | 8/2007 | |
| WO | WO 2007017726 | A1 * | 2/2007 | ..... D06F 37/266 |

* cited by examiner

*Primary Examiner* — Michael Barr
*Assistant Examiner* — Rita Adhlakha

(57) ABSTRACT

A laundry treating appliance may include a front panel with an opening, a door selectively opening and closing the front panel opening, a tub with an opening at least partially aligned with the front panel opening, and a bellows extending between the front panel and the tub at their respective openings. A deflector mounted to the tub extends towards the door and overlies at least a portion of the bellows.

18 Claims, 6 Drawing Sheets

LAUNDRY TREATING APPLIANCE WITH LAUNDRY DEFLECTOR

BACKGROUND

Laundry treating appliances, such as clothes washers, refreshers, and non-aqueous systems, may have a configuration based on a rotating drum that defines a treating chamber in which laundry items are placed for treating according to a cycle of operation. The drum may be mounted within a tub positioned within a chassis having a front panel. Typically, the front panel and the tub have openings that are generally aligned and connected by a bellows that accommodates vibratory movement of the tub when the drum rotates. The front panel may be selectively closed by a door, which can include a window that protrudes inward towards the tub to effectively block laundry falling out of the rotating drum from the bellows so as to prevent the laundry from being lodged within the bellows and to protect the bellows from frictional erosion between the moving laundry and the bellows.

BRIEF SUMMARY

According to an embodiment of the invention, a laundry treating appliance for treating laundry according to an automatic cycle of operation comprises a chassis defining an interior, a front panel provided with the chassis and defining a front panel opening to the interior, a door movable relative to the front panel selectively opening and closing the front panel opening, a tub located within the interior and at least partially defining a treating chamber, the tub having a tub opening at least partially aligned with the front panel opening providing access to the treating chamber through the front panel opening and the tub opening when the door is opened, a bellows extending between the front panel and the tub at their respective openings, and a deflector mounted to the tub and extending towards the door so as to overlie at least a portion of the bellows.

DETAILED DESCRIPTION

Figure 1:
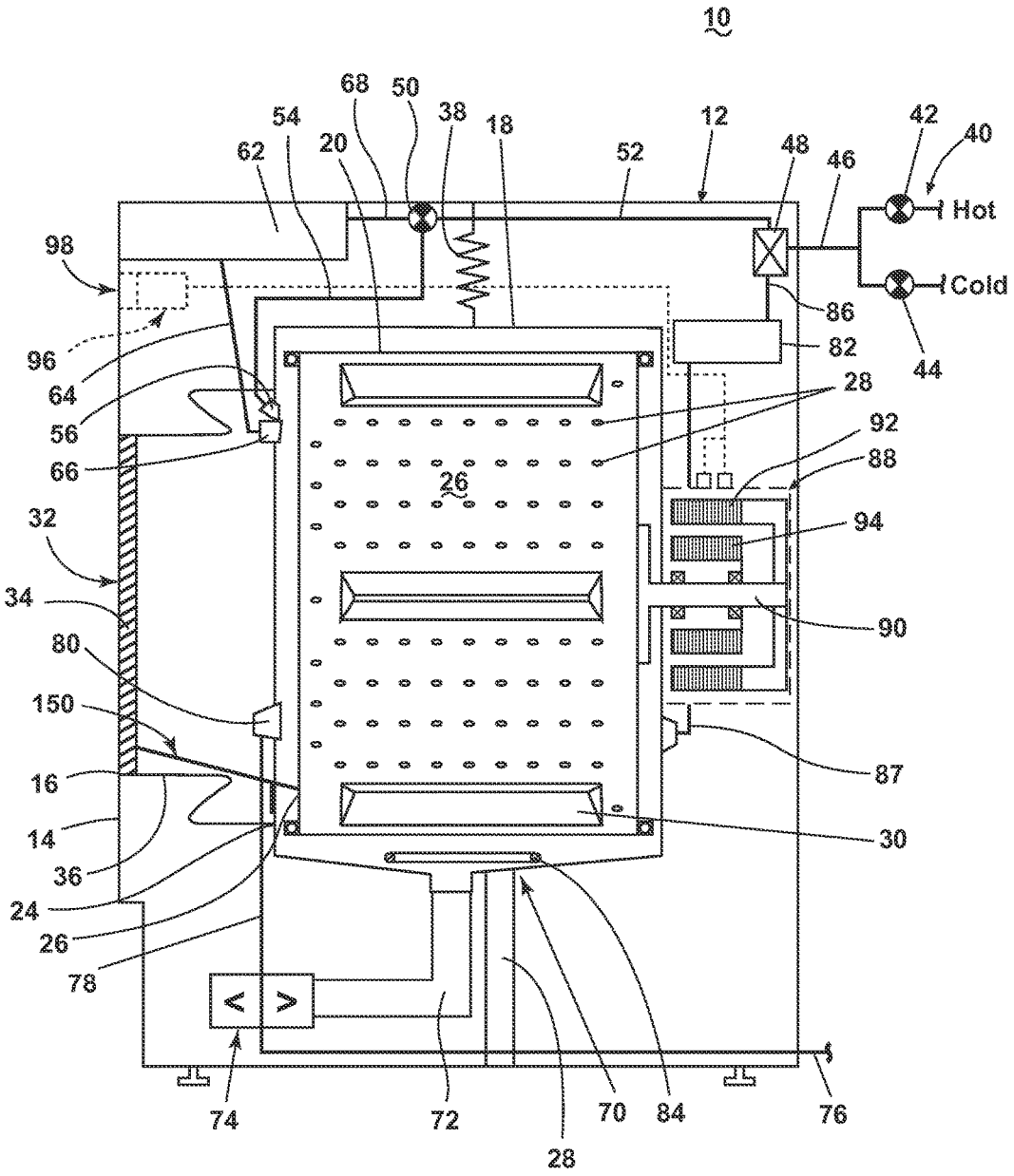
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 within which a laundry holding system resides. The cabinet 12 may be a housing having a chassis including a frame defining an interior and a front bulkhead and a rear bulkhead mounted to the frame to further define the interior and provide strength to the cabinet 12. The cabinet may further include decorative panels mounted to the chassis, typically on the top, sides, and front of the cabinet 12. Thus, the front of the cabinet 12 may include, in one example, a front bulkhead and a front decorative panel. Regardless of the particular structure forming the front of the cabinet 12, the front of the cabinet 12 will be referred to herein as a front panel 14. The front panel 14 includes an opening 16 providing access to the interior defined within the chassis. The interior encloses components typically found in a conventional washing machine, such as motors, pumps, fluid lines, controls, sensors, transducers, and the like. Such components will not be described further herein except as necessary for a complete understanding of the invention.

The laundry holding system comprises a tub 18 supported within the cabinet 12 by a suitable suspension system and a drum 20 provided within the tub 18, the drum 20 defining at least a portion of a laundry treating chamber 22. It is also within the scope of the invention for the laundry holding system to comprise only a tub with the tub defining the laundry treating chamber. When the laundry holding system comprises both the tub 18 and the drum 20, either or both of the tub 18 and the drum 20 may be considered to define the treating chamber 22 as the space that constitutes the treating chamber 22 is technically within both the tub 18 and the drum 20, with the drum 20 effectively carving out a portion of the space defined by the tub 18 for the treating chamber 22.

The tub 18 and the drum 20 both include an opening 24, 26 generally aligned with the front panel opening 16 to provide access into the treating chamber 22. To be aligned, the openings 16, 24, 26 need only have at least a portion overlapping each other such that access to the treating chamber 22 can be obtained through the openings 16, 24, 26; the openings 16, 24, 26 may be perfectly aligned with coincident centers, but even offset yet overlapping openings 16, 24, 26 are still considered generally aligned. The drum 20 may include a plurality of perforations 28 such that liquid may flow between the tub 18 and the drum 20 through the perforations 28. A plurality of baffles 30 may be disposed on an inner surface of the drum 20 to lift the laundry load received in the treating chamber 22 while the drum 20 rotates.

The laundry holding system may further include a door 32 which may be movably mounted to the cabinet 12 to selectively close the front panel opening 16. The door 32 may include a window 34, such as a generally flat, planar glass and/or plastic window, to allow a user to view the interior through the window 34 when the door 32 closes the opening 16. A bellows 36 may couple the tub 18 with the front panel 14 of the cabinet 12 at their respective openings 24, 16. The bellows 36 may be mounted to the front panel 14 and the tub 18 at locations directly adjacent the openings 16, 24, but is also feasible for the mounting of the bellows 36 to be spaced from the openings 16, 24 depending on the particular structure of the front panel 14 and the tub 18. An exemplary mounting of the bellows 36 to the tub 18 will be described in further detail below.

The washing machine 10 may further include a suspension system 38 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 18 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 18. In this manner, water from the household water supply 40 may be supplied directly to the tub 18.

The washing machine 10 may also be provided with a dispensing system for dispensing treating chemistry to the treating chamber 22 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, now U.S. Pat. No. 8,196,441, issued Jun. 12, 2012. entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, now U.S. Pat. No. 8,388,695, issued Mar. 5, 2013, entitled "Apparatus and Method for Controlling Laundering Cycle by Sensing Wash Aid Concentration," U.S. Pub. No. 2010/0000573 to Hendrickson et al., filed Jul. 1, 2008, now U.S. Pat. No. 8,397,328, issued Mar. 19, 2013, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, now U.S. Pat. No. 8,397,544, issued Mar. 19, 2013, entitled "Household Cleaning Appliance with a Single Water Flow Path for Both Non-Bulk and Bulk Dispensing," and U.S. Pub. No. 2012/0266389, filed Apr. 25, 2011, now U.S. Pat. No. 8,438,881, issued May 14, 2013, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 18 or mixed with water from the liquid supply system through a dispensing outlet conduit 64. The dispensing outlet conduit 64 may include a dispensing nozzle 66 configured to dispense the treating chemistry into the tub 18 in a desired pattern and under a desired amount of pressure. For example, the dispensing nozzle 66 may be configured to dispense a flow or stream of treating chemistry into the tub 18 by gravity, i.e., a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 18 through the tub outlet conduit 54 and/or the dispensing supply conduit 68 typically enters a space between the tub 18 and the drum 20 and may flow by gravity to a sump 70 formed in part by a lower portion of the tub 18. The sump 70 may also be formed by a sump conduit 72 that may fluidly couple the lower portion of the tub 18 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 20. The recirculation inlet 80 may introduce the liquid into the drum 20 in any suitable manner, such as by spraying, dripping, or providing a steady flow of liquid. In this manner, liquid provided to the tub 18, with or without treating chemistry may be recirculated into the treating chamber 22 for treating the laundry within.

The liquid supply and/or recirculation and drain system may be provided with a heating system which may include one or more devices for heating laundry and/or liquid supplied to the tub 18, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 18 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or the sump heater 84 may be used to heat the laundry and/or liquid within the tub 18 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 20 within the tub 18. The drive system may include a motor 88, which may be directly coupled with the drum 20 through a drive shaft 90 to rotate the drum 20 about a rotational axis during a cycle of operation. The motor 88 may be a brushless permanent magnet (BPM)

motor having a stator 92 and a rotor 94. Alternately, the motor 88 may be coupled to the drum 20 through a belt and a drive shaft to rotate the drum 20, as is known in the art. Other motors, such as an induction motor or a permanent split capacitor (PSC) motor, may also be used. The motor 88 may rotate the drum 20 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
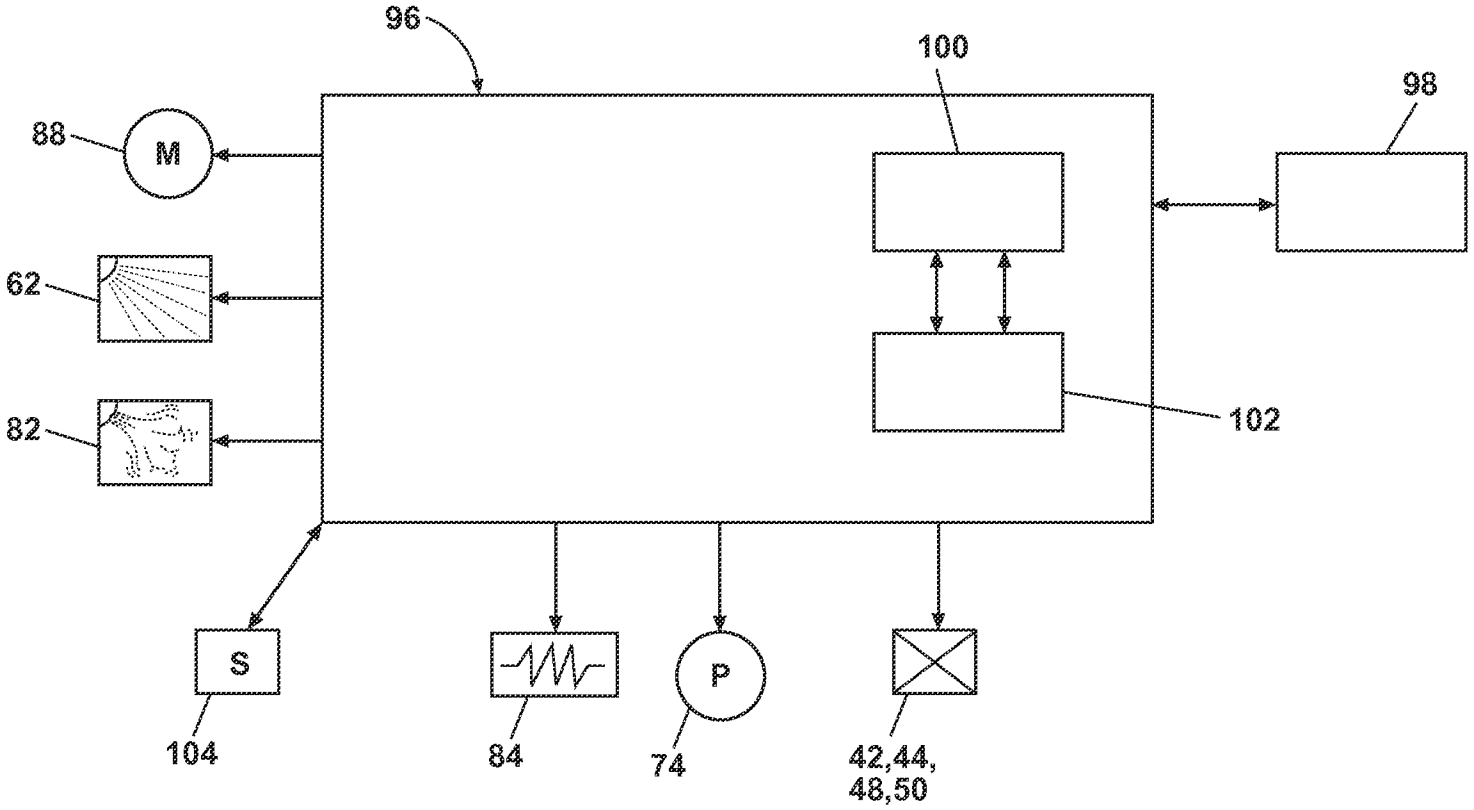
FIG. 2 is a schematic of a control system of the laundry treating appliance of FIG. 1.

As illustrated in the schematic diagram of FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82, and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, and a motor torque sensor, which may be used to determine a variety of system and laundry characteristics, such as laundry load inertia or mass.

Figure 3:
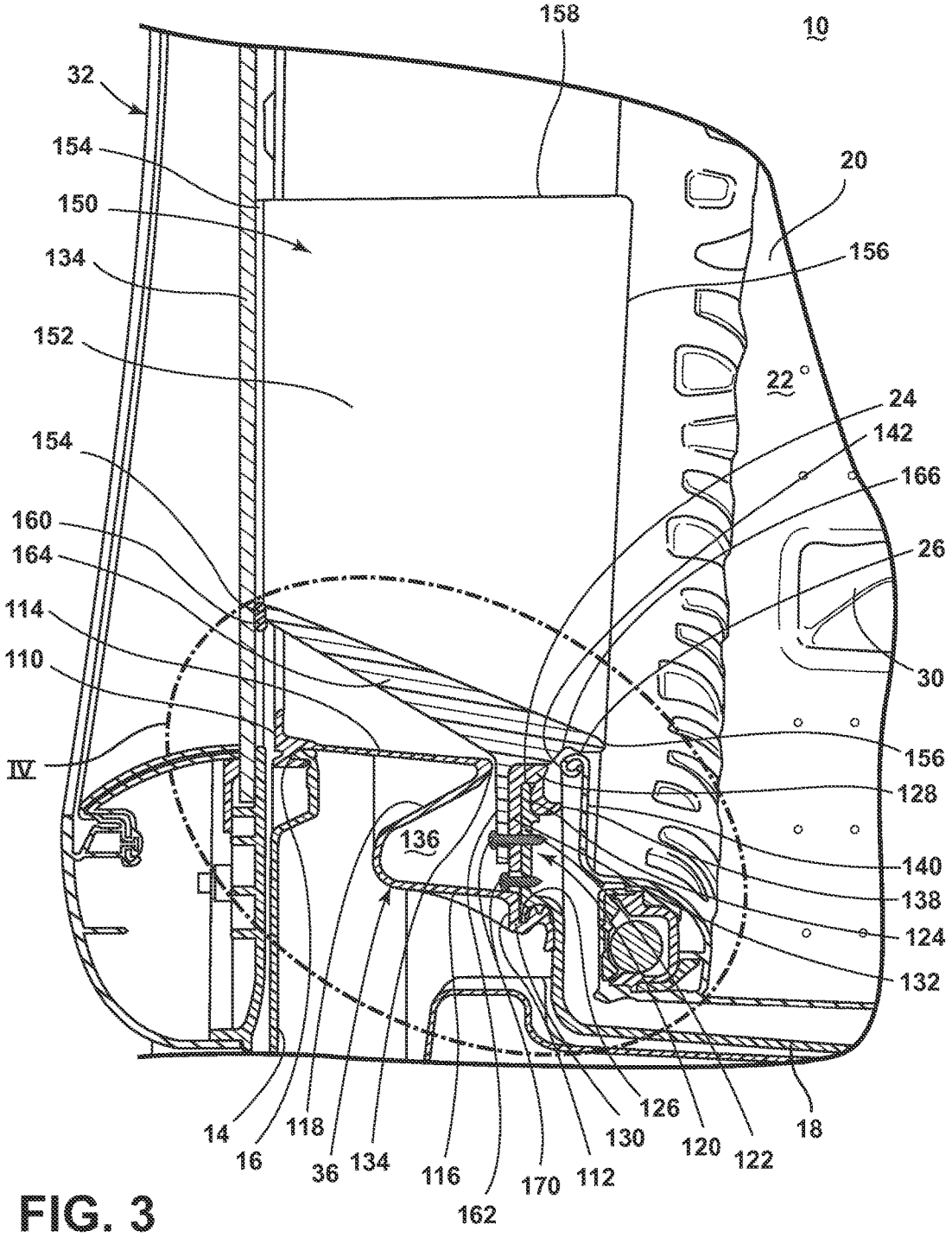
FIG. 3 is a vertical cross-sectional view taken through the center of a door of the laundry treating appliance of FIG. 1 showing an embodiment of a deflector.

FIG. 3 is a vertical cross-sectional view taken through the center of the door window 34 showing the configuration of the bellows 36. While the bellows 36 may have any suitable configuration, the illustrated exemplary bellows 36 of the present embodiment has a generally tubular configuration defined between a front end 110 mounted to the front panel 14 and a rear end 112 mounted to the tub 18, wherein the relative directions "front" and "rear" are defined with respect to a longitudinal axis of the treating chamber 22 from the perspective of a user standing in front of and facing the front panel 14. The bellows 36 includes a front portion 114 having a generally circular transverse cross-sectional configuration and extending rearwardly from the front end 110. Similarly, the bellows 36 includes a rear portion 116 having a generally circular transverse cross-section and extending forwardly from the rear end 112. The rear portion 116 may have a larger diameter than the front portion 114 to accommodate differences in the sizing of the openings 16, 24 for the front panel 14 and the tub 18. A corrugated portion 118, sometimes referred to as an S-fold, may join the front and rear portions 114, 116 at their rear and front ends, respectively, which may overlap one another.

Figure 4:
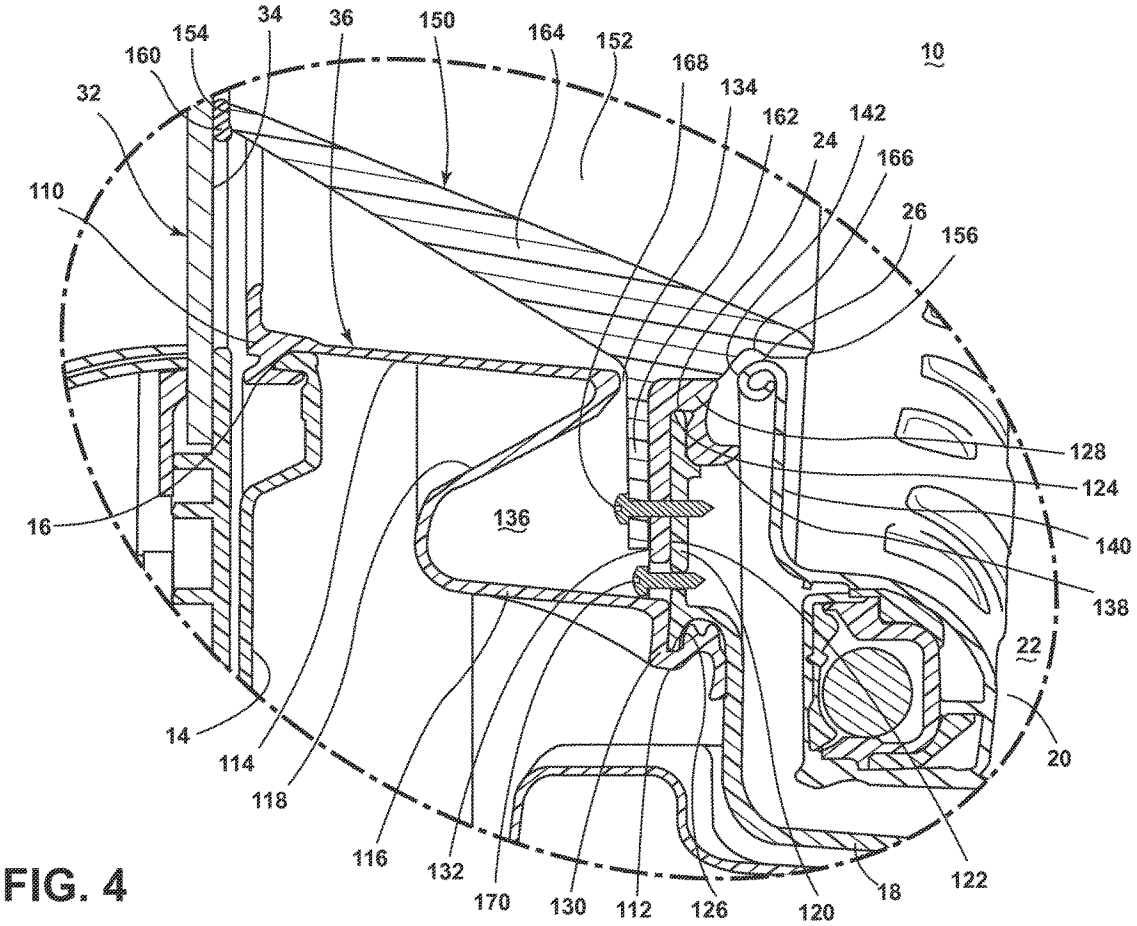
FIG. 4 is an enlarged view of the region identified as IV in FIG. 3.

Referring now to FIG. 4, which is an enlarged view of the region labeled IV in FIG. 3, the bellows rear end 112 may be adapted for mounting of the bellows 36 to the tub 18. In the present embodiment, the tub 18 includes a forwardly extending annular protrusion 120 having a generally T-shaped cross-sectional configuration defined by a generally flat front face 122 terminating at inner and outer edges 124, 126, and the bellows rear end 112 may include inner and outer lips 128, 130 that wrap around the inner and outer edges 124, 126, respectively, of the protrusion 120. As used herein, the relative directions "inner" and "outer" are radial, with "inner" being closer to the center of washing machine 10 than "outer." The outer lip 130 may be generally continuous with the rear portion 116 of the bellows 36, while the inner lip 128 may be radially spaced from the outer lip 130 by an inwardly extending annular flange 132. The inner and outer lips 128, 130 and the flange 132 may form a T-shaped channel that receives the tub protrusion 120. Further, this configuration of the illustrated bellows 36 forms a gap 134 between the front portion 114 and the flange 132 that leads into a space 136 defined by the corrugated portion 118, the rear portion 116, and the flange 132.

Additionally, the inner lip 128 may include a rearwardly extending annular spacer 138 that longitudinally spaces the tub 18 from the drum 20 at their respective openings 24, 26, thus preventing the drum 20 from hitting the tub 18, such as during rotation of the drum 20, along a longitudinal direction. In the illustrated embodiment, the front of the drum 20 may include an inwardly extending annular flange 140 terminating at a curled front edge 142, and the spacer 138 spaces the drum flange 140 from the tub protrusion 120.

The washing machine may further include a deflector 150 mounted to the tub 18 and overlying at least a portion of the bellows 36. The deflector 150 functions to encourage movement of the laundry that may fall out of the drum 20, which may occur during rotation of the drum 20, back into the drum 20. The deflector 150 may also protect the bellows 36 from frictional wear that may occur due to laundry rubbing against the bellows 36 and help prevent laundry and possibly other items, such as detergent pods and objects that have fallen out of pockets, from undesirably falling through the gap 134 into the space 136.

Figure 5:
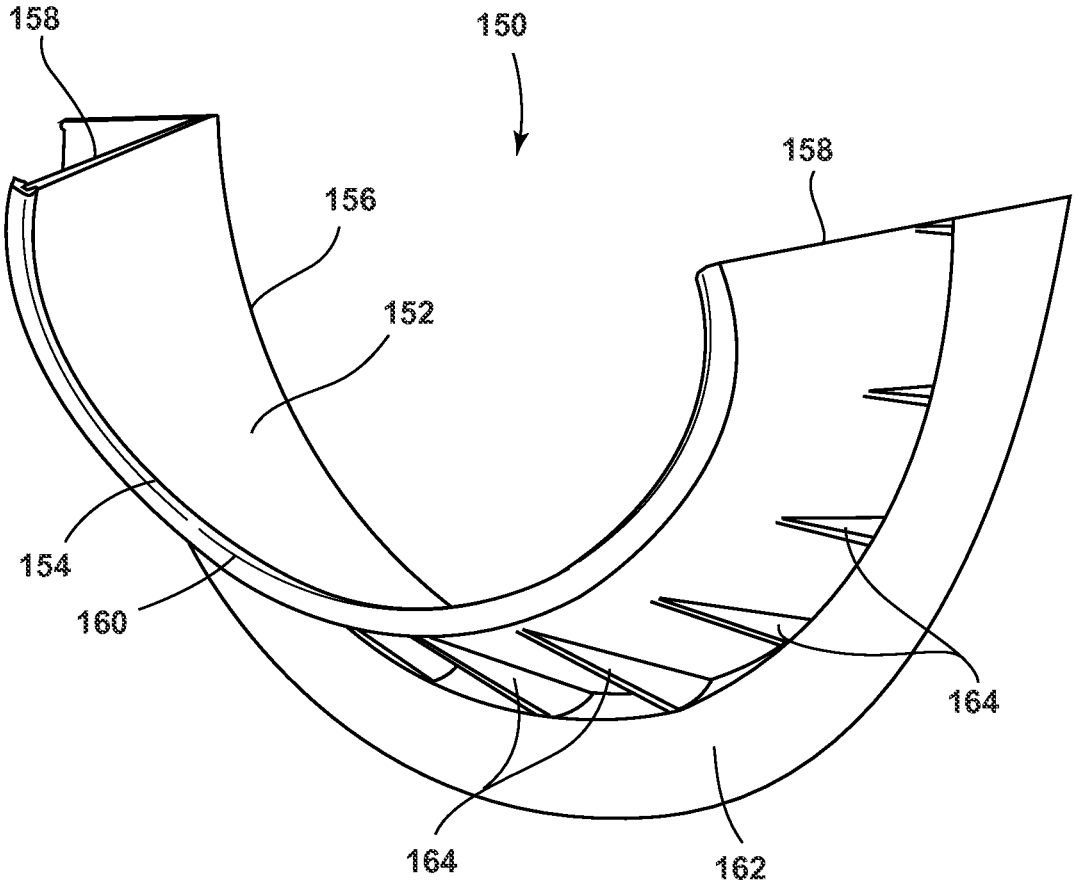
FIG. 5 is a perspective view of the deflector of FIG. 3.

Referring now to the perspective view of the deflector in FIG. 5, the deflector 150 includes an arcuate body 152 defined in a longitudinal direction between front and rear edges 154, 156 and in a circumferential direction between side edges 158. The body 152 may be considered as having side portions adjacent the side edges 158 that transition toward a lower portion that angles or slopes downward from the front edge 154 to the rear edge 156. At its lowermost point, the body 152 may have an inclination angle of about 20 degrees, with it being understood that other inclination angles are acceptable. Exemplary inclination angles at the lowermost point of the body 152 include a range from about 0 degrees to about 35 degrees. The inclination angle may decrease moving from the lowermost point of the body 152 towards the side edges 158. For example, the angle of inclination for the body 152 may range from about 0 degrees to about 35 degrees. Factors to consider in selection of the inclination angle include performance, laundry load capacity, and materials. The slope of the body 152 may be continuous from the front edge 154 to the rear edge 156, as illustrated. Alternatively, the body 152 may be generally horizontal near the front edge 154 for an axial distance and then slope downward at the inclination angle towards to the rear edge 156. Further, the side edges 158 may curl inward, optionally with a severity of curling greatest at the front edge 154 and decreasing moving toward the rear edge 156. The radius of curvature of the body 152 may vary across the surface of the body 152 as desired.

A resilient guard 160 may be disposed along at least a portion of and possibly the entire front edge 154 of the body 152. The guard 160 may be made of any suitable generally resilient or compliant polymeric material and may be formed integrally with the body, such as by co-molding or over-molding processes, or may be made separately and attached by any suitable means, including adhesives, welding, and mechanical fasteners. Exemplary resilient materials include, but are not limited to, Santoprene™ thermoplastic rubber and ethylene propylene diene monomer (EPDM) rubber.

A generally arcuate, radial flange 162 may depend from a lower side of the body 152 to facilitate mounting of the deflector 150. The flange 162 may have any suitable dimensions, and an exemplary radial height of the flange 162 is about 35 mm (1.38 in.). The flange 162 may extend from one of the side edges 158 to the other side edge 158, as illustrated, or may have a shorter length or be formed as a series of discontinuous, circumferentially spaced flanges, if desired. The flange 162 may have any suitable position relative to the front and rear edges 154, 156 in the longitudinal direction, and, in the illustrated example, the flange 162 may be spaced about 15 mm (0.59 in.) forward of the rear edge 156. Additionally, the flange 162 may lie in a generally vertical plane, as illustrated, or be angled if necessary for mounting of the deflector 150.

The deflector 150 may further include one or more ribs 164 on a lower side of the body 152 to support the sloped configuration of the body 152. The ribs 164 may extend longitudinally forward from the flange 162 and may be spaced circumferentially from each other. While the ribs may have any suitable shape, the illustrated ribs 164 are generally triangular and decrease in size, both longitudinally and radially, from the lowest point of the body 152, where the inclination angle of the body 152 is greatest, toward the side edges 158. The ribs 164 may be sized so as to prevent contact with the bellows 36 when mounted to the tub 18 (FIGS. 3 and 4).

Figure 6:
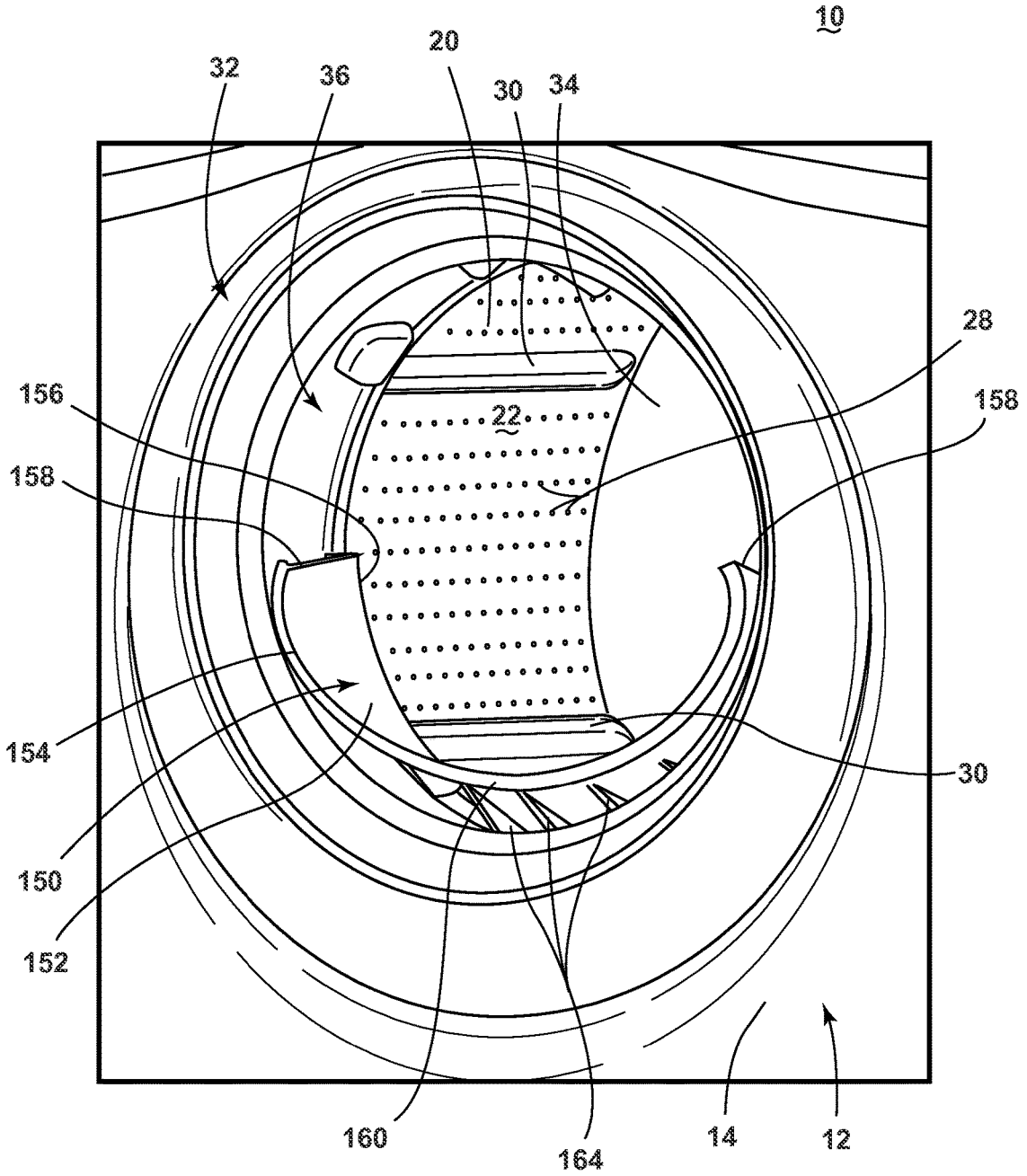
FIG. 6 is a front perspective view of a portion of the washing machine of FIG. 1 with the deflector of FIG. 3.

FIG. 6 is a front perspective view of a portion of the washing machine 10 showing the position of the deflector 150 mounted within the washing machine 10. As mentioned previously, the deflector 150, particularly the body 152 of the deflector 150, overlies at least a portion of the bellows 36. The deflector 150 may be positioned to overlie a lower portion of the bellows 36 for catching the laundry that has fallen out of the drum 20 and encouraging the fallen laundry to slide back into the drum 20. In the illustrated embodiment, the bellows 36 may have a generally circular transverse cross-sectional configuration, and the deflector 150 may be positioned to overlie the lower half of the circle, such as from a three o'clock position to a nine o'clock position, i.e., a 180 degree circumferential extension. The deflector 150 may have any suitable circumferential extension and may be centered at a six o'clock position and extend upward a desired amount in both circumferential directions. Testing has shown that laundry tends to hit the bellows area at about the eight o'clock position when falling out of the drum 20 during rotation, and, in one embodiment, it may be desirable for the deflector 150 to extend circumferentially to at least this position in both directions. Other exemplary circumferential extension values include about 240 degrees.

Returning to FIG. 4, the cross-sectional view depicts the longitudinal or axial extension of the deflector 150 with respect to the bellows 36. In the illustrated embodiment, the deflector 150, particularly the body 152 of the deflector 150, extends axially over the entire depth of the bellows 36 from the front panel opening 16 to the tub opening 24 and beyond to at least the drum opening 26. For the configuration of the illustrated washing machine 10, such axial extension is about 115 mm (4.53 in.). The deflector 150 may have any suitable axial extension and may extend from at least the drum opening 26, to provide continuity between the deflector 150 and the drum 20 so that the fallen laundry returns to the drum 20, any suitable axial distance toward the door 32 that selectively closes the front panel opening 16. Preferably, the deflector 150 extends forward axially at least a distance wherein the body 152 overlies the bellows gap 134 to prevent items from undesirably falling through the gap 134 into the bellows space 136. Other exemplary axial extension values include 75 mm (2.95 in.).

The guard 160 may provide a cushioned interface between the front edge 154 of the deflector 150 and the door window 34, especially when the deflector 150 extends axially to the door 32. The guard 160 may be in abutting contact with the window 34, either continuously or intermittently as a result of tub vibrations during rotation of the drum 20. The resilient material forming the guard 160 absorbs at least some of the impact of the deflector 150 hitting the window 34, thus protecting the window 34 and the deflector 150 and reducing the volume of the noise generated during the hitting.

The other end of the deflector 150, the rear edge 156, may overlie, and optionally extend beyond, the front edge 142 of the drum 20 to ensure continuous movement of fallen laundry from the deflector 150 into the drum 20. Such a configuration precludes formation of a gap between the deflector rear edge 156 and the drum 20 within which laundry and other items could potentially become lodged. The deflector 150 may be radially spaced from the drum front edge 142 to accommodate movement of the drum 20 during its rotation. As seen in FIG. 4, the deflector 150 may include a channel 166 formed on the bottom side of the body 152 and sized and shaped according to the drum front edge 142 and to provide the desired radial spacing between the deflector 150 and the drum front edge 142. As an example, the radial spacing may be within a range of about 5 mm (0.20 in.) to about 12 mm (0.47 in.). The channel 166 may extend circumferentially along the entire deflector body 152 or a desired portion thereof. Alternatively, the deflector 150 need not include a channel, wherein the lower side of the deflector body 152 is generally planar and spaced radially from the drum front edge 142.

The deflector 150 may be mounted to the tub 18 with the mounting flange 162. In particular, the deflector mounting flange 162 is inserted through the bellows gap 134 and into the bellows space 136 and positioned generally coplanar with the flat front face 122 of the tub protrusion 120 with the bellows flange 132 therebetween. Mechanical fasteners 168 may be inserted through the deflector mounting flange 162, the bellows flange 132, and the tub protrusion 120 to secure the deflector 150 to the tub 18. Other mounting methods are feasible, including welding and adhesives. The deflector 150 may be mounted to the tub 18 at the bottom of the tub opening 24 so that the deflector 150 is positioned to overlie the lower portion of the bellows 36, as illustrated. Separate mechanical fasteners 170 may be employed to mount the bellows 36 to the tub 18, such as through openings provided on the bellows 36 and the tub protrusion 120 below the deflector mounting flange 162, as shown in FIG. 4.

During operation of the washing machine 10, various portions of an operation cycle may include rotation of the drum 20 to rotate the laundry held within the treating chamber 22. As mentioned above, some of the laundry may fall out of the drum 20 into the area defined between the front panel opening 16 and the tub and drum openings 24, 26, i.e., the area with the bellows 36. Some of the laundry may fall onto the deflector 150, which, due to the inclination angle of the body 152, encourages the fallen laundry to slide downward and rearward for depositing back into the drum 20. It is possible that some of the fallen laundry may continue, due to momentum, to rotate along the deflector 150 to the upper portion of the deflector 150, in which case, the curled side edges 158 (FIGS. 3 and 6) direct the laundry inward and downward towards the lower portion of the deflector 150, where the laundry can slide down the inclined body 152 for depositing back into the drum 20. Additionally, the deflector 150 protects the bellows 36 by preventing the fallen laundry from rubbing against the bellows 36 and also prevents, due to covering the gap 134, laundry and other items from falling into the space 136 through the gap 134.

Mounting the deflector 150 to the tub 18 provides several advantages. For example, such mounting results in the deflector 150 being stationary with respect to the tub 18. Although the tub 18 does not rotate, it is part of the suspended laundry holding system and undergoes some vibrational movement during rotation of the drum 20. Mounting the deflector 150 to the tub 18 for cooperative movement maintains the position of the deflector 150 with respect to the tub 18 and prevents formation of undesirable gaps between the deflector 150 and the tub and drum openings 24, 26 at the rear edge 156 of the deflector 150. Any gaps resulting from movement of the deflector 150 would be located at the front edge 154 near the door 32, which is farther away from the laundry, thus resulting in a smaller likelihood of the laundry getting caught and clogged in such gaps. Further, the use of the deflector 150 allows the door window 34 to be generally flat rather than a window that protrudes inward towards the tub 18, as described in the background, because the deflector 150 blocks the laundry from the bellows 36, thus rendering the protruding window unnecessary. Advantageously, using a generally flat window increases the capacity of the washing machine 10 and improves visual observation of the laundry load in the treating chamber 22 compared to the use of a protruding window.

The deflector 150 may be altered in any suitable manner. For example, the deflector 150 may be configured to be removably mounted to the tub 18 without tools such that a user may be able to easily remove the deflector 150 from the washing machine 10, such as for cleaning or replacement. Such a removable connection may be formed by, for example, mating tabs and slots, such as mating pins and keyhole slots, detents, bayonet connections, and the like. As another alterative, the deflector 150 may form a complete ring such that the deflector 150 extends circumferentially completely around the bellows 36.

To the extent not already described, the different features and structures of the various embodiments may be used in combination with each other as desired. That one feature may not be illustrated in all of the embodiments is not mean to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry according to an automatic cycle of operation, the appliance comprising:

a chassis defining an interior;

a front panel provided with the chassis and defining a front panel opening to the interior;

a door movable relative to the front panel selectively opening and closing the front panel opening;

a tub located within the interior and at least partially defining a treating chamber, the tub having a tub opening at least partially aligned with the front panel opening providing access to the treating chamber through the front panel opening and the tub opening when the door is opened;

a bellows extending between the front panel and the tub at their respective openings; and a deflector mounted to the tub and extending towards the door so as to cover at least a portion of the bellows and where a portion of the deflector abuts the door when the door is closed.

2. The laundry treating appliance of claim 1 wherein the portion of the deflector comprises a compliant guard that abuts the door when the door is closed.

3. The laundry treating appliance of claim 2 wherein the compliant guard is made of a resilient material.

4. The laundry treating appliance of claim 1 wherein the deflector has an arcuate configuration with respect to an axis passing through a center of at least one of the tub opening and front panel opening.

5. The laundry treating appliance of claim 4 wherein the bellows is generally tubular, and the deflector having the arcuate configuration overlies at least a portion of the bellows on a lower half of the bellows.

6. The laundry treating appliance of claim 4 wherein the deflector terminates in at least one side edge that curls inward deflecting laundry rotationally moving along the deflector downward onto the deflector.

7. The laundry treating appliance of claim 1 wherein a portion of the deflector slopes downward in a direction from the door towards the tub encouraging movement of laundry into the treating chamber.

8. The laundry treating appliance of claim 7 wherein the portion of the deflector slopes downward at an inclination angle of about 20 degrees.

9. The laundry treating appliance of claim 7 wherein the deflector has a front end proximate the door and a rear end proximate the tub, and a slope of the deflector is continuous from the front end to the rear end.

10. The laundry treating appliance of claim 7 wherein the deflector further includes at least one strengthening rib on a lower side of the deflector.

11. The laundry treating appliance of claim 1 wherein the deflector is mounted to the tub at a bottom of the tub opening.

12. The laundry treating appliance of claim 1 wherein the deflector includes a downwardly extending flange, and the deflector is mounted to the tub with fasteners that extend through the flange.

13. The laundry treating appliance of claim 1, further comprising a drum rotatably mounted within the tub, and the deflector overlies a front edge of the drum.

14. The laundry treating appliance of claim 13 wherein the deflector is radially spaced from the front edge of the drum.

15. The laundry treating appliance of claim 14 wherein the radial spacing is between about 5 mm and about 12 mm.

16. The laundry treating appliance of claim 1 wherein the deflector overlies substantially the entire bellows along a direction from the front panel to the tub.

17. The laundry treating appliance of claim 1 wherein the deflector is mounted to the tub at a location different than a location where the bellows is mounted to the tub.

18. A laundry treating appliance for treating laundry according to an automatic cycle of operation, the appliance comprising:

a chassis defining an interior;

a front panel provided with the chassis and defining a front panel opening to the interior;

a door movable relative to the front panel selectively opening and closing the front panel opening;

a tub located within the interior and at least partially defining a treating chamber, the tub having a tub opening at least partially aligned with the front panel opening providing access to the treating chamber through the front panel opening and the tub opening when the door is opened;

a bellows extending between the front panel and the tub at their respective openings; and a deflector mounted to the tub and extending towards the door so as to overlie a majority of the bellows to cover the bellows and encourage movement of laundry into the treating chamber, wherein a portion of the deflector abuts the door when the door is closed.

* * * * *